US006416145B1

(12) United States Patent
Singh

(10) Patent No.: US 6,416,145 B1
(45) Date of Patent: Jul. 9, 2002

(54) DRAWER SLIDE UNDERMOUNT BRACKET WITH FLEXIBLE LOCKING TAB

(75) Inventor: Atma Kainth Singh, Fullerton, CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 0 days.

(21) Appl. No.: 09/422,818

(22) Filed: Oct. 21, 1999

Related U.S. Application Data

(63) Continuation of application No. 08/842,011, filed on Apr. 23, 1997, now Pat. No. 5,980,077.

(51) Int. Cl.[7] ..... A47B 88/00

(52) U.S. Cl. ..... 312/334.1; 312/333; 312/334.44

(58) Field of Search ..... 312/334.7, 334.11, 312/334.8, 334.4, 334.5, 330.1, 333, 334.44, 334.46, 334.47, 334.1; 384/20, 21, 22, 41; 248/222.22, 225.11

(56) References Cited

U.S. PATENT DOCUMENTS 2,720,000 A * 10/1955 Gussack ..... 312/334.44 X
2,859,070 A * 11/1958 Gomersall ..... 312/333 X
2,872,271 A * 2/1959 Niedringhaus et al. ..... 312/333
3,133,768 A * 5/1964 Klakovich ..... 312/334.8 X
3,771,849 A * 11/1973 Barber ..... 312/350
4,272,138 A * 6/1981 Stark ..... 312/333 X
4,435,029 A * 3/1984 McKenzie ..... 312/333 X
4,537,450 A * 8/1985 Baxter ..... 308/3.8
4,681,381 A * 7/1987 Sevey ..... 312/333
4,998,828 A * 3/1991 Hobbs ..... 384/21 X
5,306,077 A * 4/1994 Trevaskis ..... 312/334.47 X
5,507,571 A * 4/1996 Hoffman ..... 312/334.8
5,632,542 A * 5/1997 Krivec ..... 312/334.7
6,209,979 B1 * 4/2001 Fall et al. ..... 312/333 X

* cited by examiner

*Primary Examiner*—Peter M. Cuomo
*Assistant Examiner*—Stephen Vu
(74) *Attorney, Agent, or Firm*—Christie, Parker & Hale, LLP

(57) ABSTRACT

A drawer slide member and drawer slide undermount bracket are provided. The drawer slide member has a vertical web having guide apertures with angled sides leading to a slot adapted to receive support tabs projecting from an undermount bracket. The undermount bracket, or shelf mount bracket, is longitudinally restricted from motion, and the support tabs thereby locked in the slots, by lock tabs located on a flexing finger within the undermount bracket which are positioned in a lock tab aperture in the web of the slide member.

4 Claims, 6 Drawing Sheets

21b
27
25
23
13
17b
19b
17a
21a
19a
11

DRAWER SLIDE UNDERMOUNT BRACKET WITH FLEXIBLE LOCKING TAB

CROSS-REFERENCE TO RELATED APPLICATION

This application is a continuation of U.S. patent application Ser. No. 08/842,011, filed on Apr. 23, 1997, now issued as U.S. Pat. No. 5,980,077.

FIELD OF THE INVENTION

The present invention relates to drawer slides and the mounting of attachments to drawer slides. The invention specifically relates to an improved drawer slide and drawer slide accessory mounting bracket.

BACKGROUND OF THE INVENTION

Telescopic slides for file drawers and the like are often desirable for use in cabinets and other rack mounted applications. Such slides permit access to the interior of the drawer. The slides maintain the drawer in a horizontal position regardless of how far the drawer is withdrawn from the cabinet. The slides are also useful in the mounting of extendable shelves in cabinets.

A typical drawer slide has two or three slide members slidably secured to each other by sets of ball bearings held be retainers riding in raceways formed on the slide members. Two element telescopic slides normally include an outer slide member and an inner slide member. For purposes of exposition, the outer slide member is connected to the cabinet or enclosure, although it is recognized that the inner slide member may instead be so connected. When the outer slide member is connected to the cabinet or enclosure, the slide member affixed to the drawer is the inner slide member. The slide members are often slidably connected through the use of ball bearings which are in rolling engagement with raceways formed on the slides. A three element telescopic slide will additionally normally include an intermediate slide member slidably connected to and between the outer and inner slide members.

A typical drawer will often have two slides securing the drawer to the cabinet or enclosure, with the slides attached to each of the outside of the vertical side walls of the drawer. The vertical side walls of the drawer, however, may be of a material inappropriate for attaching slides thereto. Additionally, the vertical side wall of a shelf is often of insufficient dimension or provides insufficient stability for mounting a drawer slide. Also, for aesthetic reasons it may be preferable to mount the shelf over the drawer slide to provide a clean and sleek look to the cabinet as a whole.

The drawer slide may be provided a flange extending from one of the slide members to allow for such mounting of a shelf or drawer. For reasons of decreasing manufacturing costs and increasing the usefulness of a particular slide, however, an accessory is generally mounted to one of the slide members, with the accessory providing a flange for the mounting of a shelf or drawer. Thus, there is a need for a drawer slide and drawer slide accessory, such as a mounting flange for shelf applications, in which the accessory and the drawer slide can be easily and securely mated.

SUMMARY OF THE INVENTION

The present invention provides a drawer slide member and a drawer slide accessory or attachment. The drawer slide accessory is attached to the drawer slide member by placing tabs located on the accessory in apertures in a vertical web of the drawer slide member. In particular, the accessory may be a shelf mount, or undermount, bracket comprised of a vertical mounting flange and a horizontal support flange. Two hook-shaped support tabs, or bayonets, astraddle a lock tab extend from one side of the mounting flange. The lock tab is mounted on a flexing finger inset in the mounting flange to provide for increased ease of removal of the shelf mount bracket from the drawer member. The drawer slide member has an aperture to receive the lock tab in the drawer slide member's vertical web, as well as two guide apertures adapted to receive the support tabs. The guide apertures have a large insertion opening with angled sides leading to a slot for securely engaging the support tabs. Thus the drawer mount or other accessory can be easily and securely removably mated to the drawer slide member.

Many of the attendant features of this invention will be more readily appreciated as the same becomes better understood by reference to the following detailed description and considered in connection with the accompanying drawings in which like reference symbols designate like parts throughout.

DETAILED DESCRIPTION OF THE INVENTION

Figure 1:
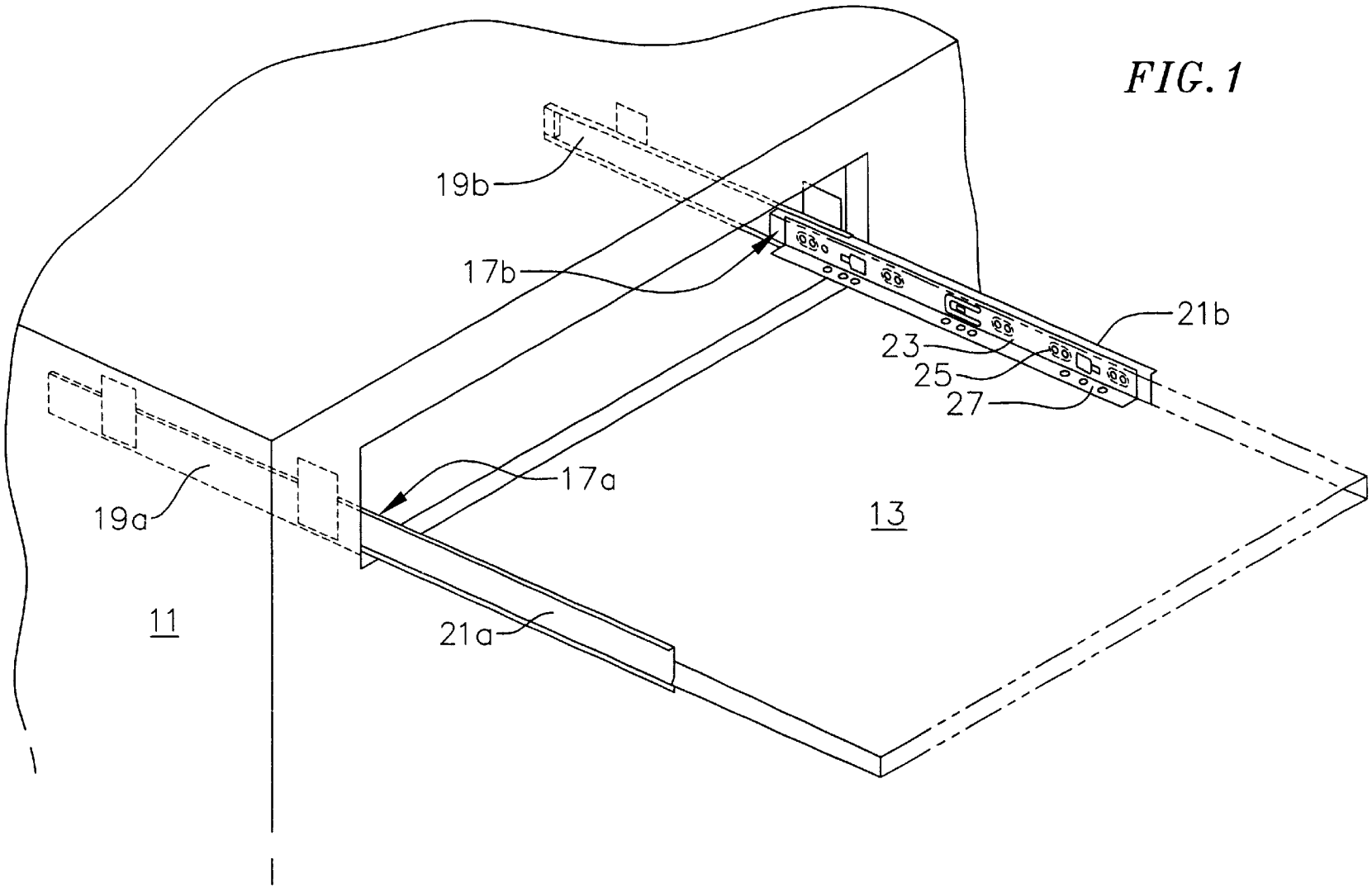
FIG. 1 is a perspective view of a cabinet with a shelf coupled to the cabinet by a drawer slide and shelf mount bracket of the present invention.

A drawer slide and shelf mount bracket incorporating the present invention are shown in FIG. 1. A shelf 13 is secured to a cabinet 11 by drawer slides 17*a,b*, and drawer slide accessories mounted to the drawer slides 17*a,b*. The drawer slides shown are two element drawer slides comprised of outer slide members 19*a,b* slidably connected to inner slide members 21*a,b*. The drawer slide accessories are attached to the inner slide members 21*a,b*. The drawer slide accessory shown is a shelf mount bracket 23 which is of a substantially L-shaped cross-section with a vertical mounting flange 25 which, when attached to a slide member, is placed against the vertical web of the inner slide member 21, and a horizontal support flange 27 extending from the vertical mounting flange 25 for supporting the shelf 13 or a drawer bottom.

Figure 7:
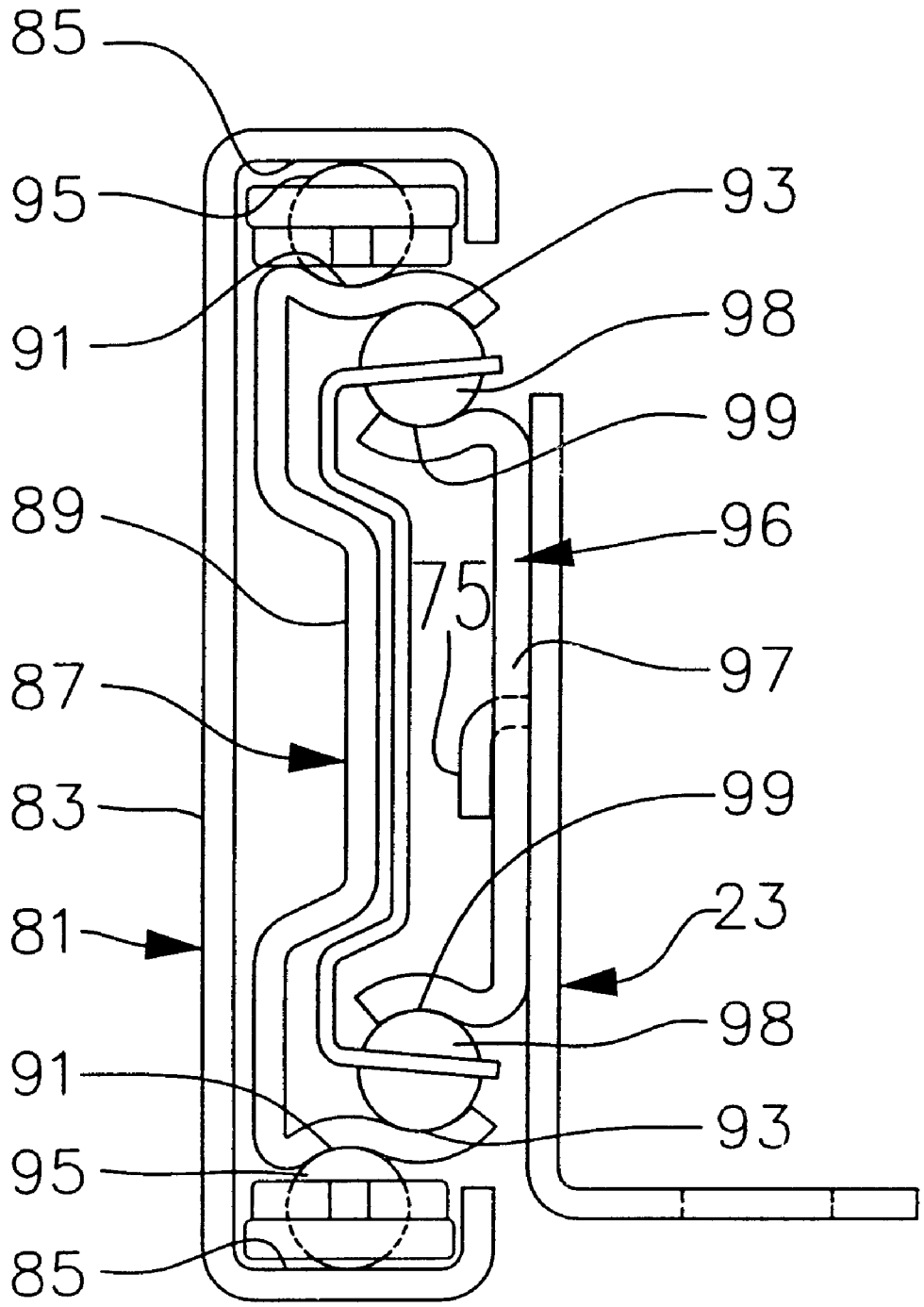
FIG. 7 is the view taken from the opposite side of the elevational view of FIG. 3 of the shelf mount bracket attached to a drawer slide member of the present invention.

FIG. 7 shows an end view of the shelf mount bracket 23 attached to a drawer slide. The drawer slide illustrated is a three member telescopic slide. A drawer slide incorporating the present invention need not be a three member slide, a slide with any number of members may be used with the present invention. The drawer slide has an outer slide member 81 with a vertical web 83 and upper and lower inward facing bearing raceways 85 extending from the upper and lower margins of the vertical web 83. The drawer slide has an intermediate slide member 87 with a vertical web 89 and upper and lower inward and outward facing arcuate bearing raceways 91,93. The intermediate slide member 87 is slidably connected to the outer slide member 81 by bearings 95 in rolling engagement with the inward facing bearing raceways 85 of the outer slide member and the outward facing raceways 91 of the intermediate slide member 87. The drawer slide also has an inner slide member 96 with a vertical web 97 and outward facing arcuate bearing raceways 99, with additional bearings 98 slidably connecting the inner and intermediate slide members. Slidably connecting the slide members allows a slide member to extend longitudinally with respect to the other slide members. The vertical webs of the outer, intermediate, and inner slide members are progressively smaller in the vertical dimension thereby allowing for nested slide member arrangement. A drawer slide incorporating the present invention need not employ such a nested configuration, however. The shelf mount bracket 23 is attached to the web 97 of inner slide member. The drawer slide accessory used with the present invention need not be a shelf mount bracket. Any slide accessory attachable longitudinally to the vertical web of a slide member may incorporate the present invention.

Figure 2:
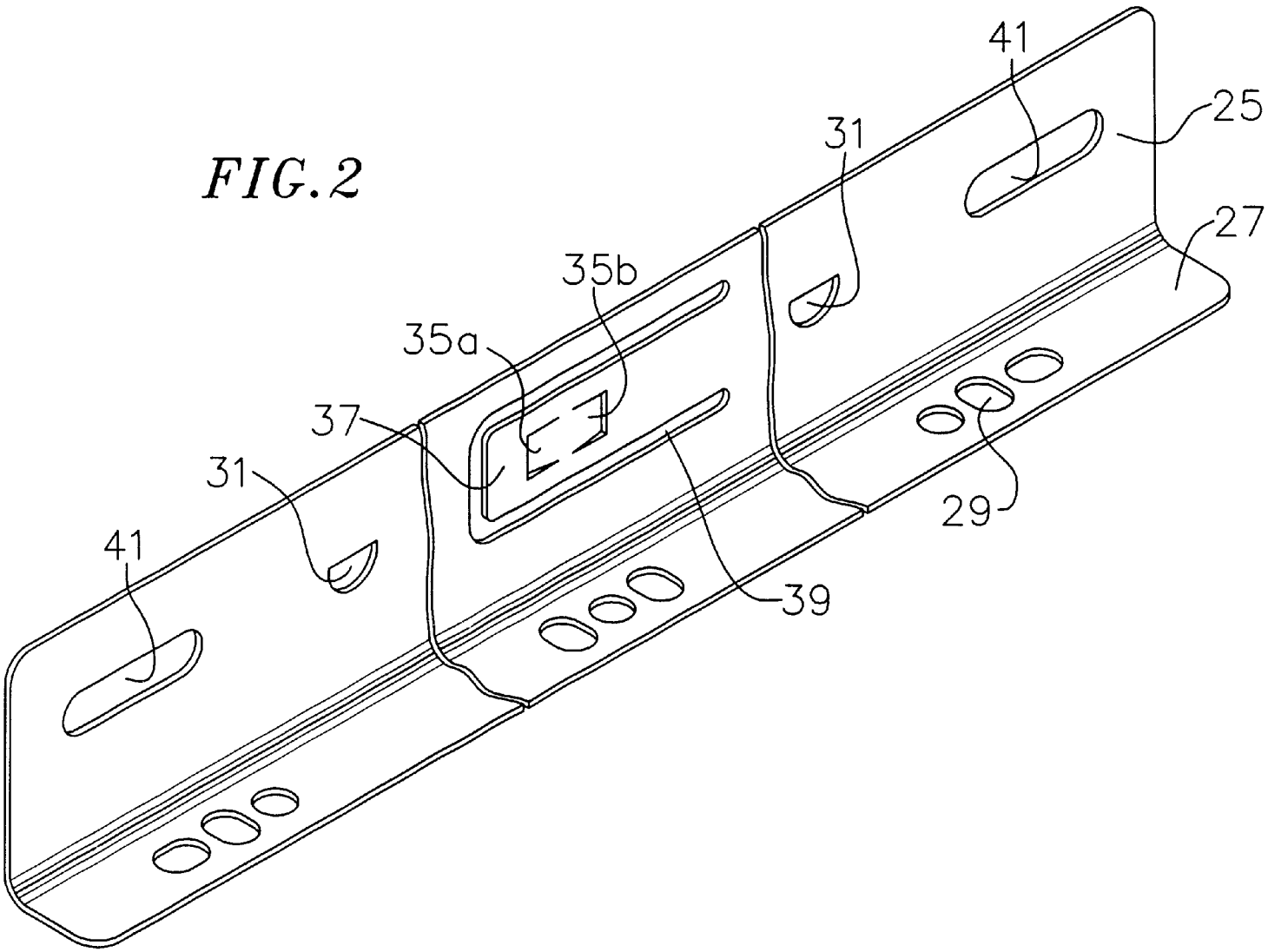
FIG. 2 is a perspective view of the shelf mount bracket of the present invention.
Figure 3:
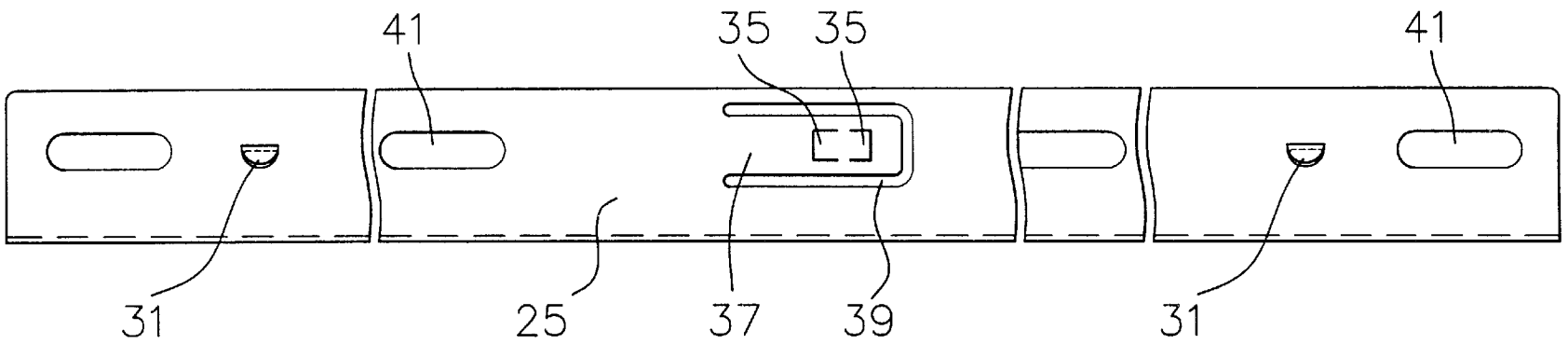
FIG. 3 is an elevational view taken from one side of the shelf mount bracket of FIG. 2.

FIGS. 2 and 3 show further details of the shelf mount bracket 23. The horizontal support flange 27 is provided with numerous holes 29 through which to pass screws, nails, and the like for thereby attaching a shelf or a similar surface. The mounting flange 25 has two hook-shaped support tabs 31 extending from the side of the mounting flange 25 facing away from the support flange 27. The support tabs, and other similarly shaped tabs, are often referred to as bayonets. The support tabs 31 may be formed through a stamping and bending operation or through other methods well known in the art. A flexing finger 37 is formed inset in the vertical mounting flange 25 by the removal of a rectangular C-shaped section 39 within the vertical mounting flange 25. The flexing finger 37 therefore extends longitudinally within the vertical mounting flange 25 of the shelf mount bracket 23. Two lock tabs 35*a,b* are formed on the flexing finger 37 and extend outward from the vertical mounting flange 25 in the direction opposite that of the support flange 27. The vertical mounting flange 25 also has several elongated access holes 41. The access holes 41 allows screws, nails, and the like to be passed through attachment holes 69 (shown in FIG. 4) in the vertical web 97 in the inner slide member 96 (also shown in FIG. 4). The elongation of the access holes 41 allows the shelf mount bracket 23 to be used with a variety of slides containing attachment holes in a variety of locations.

Figures 5, 6:
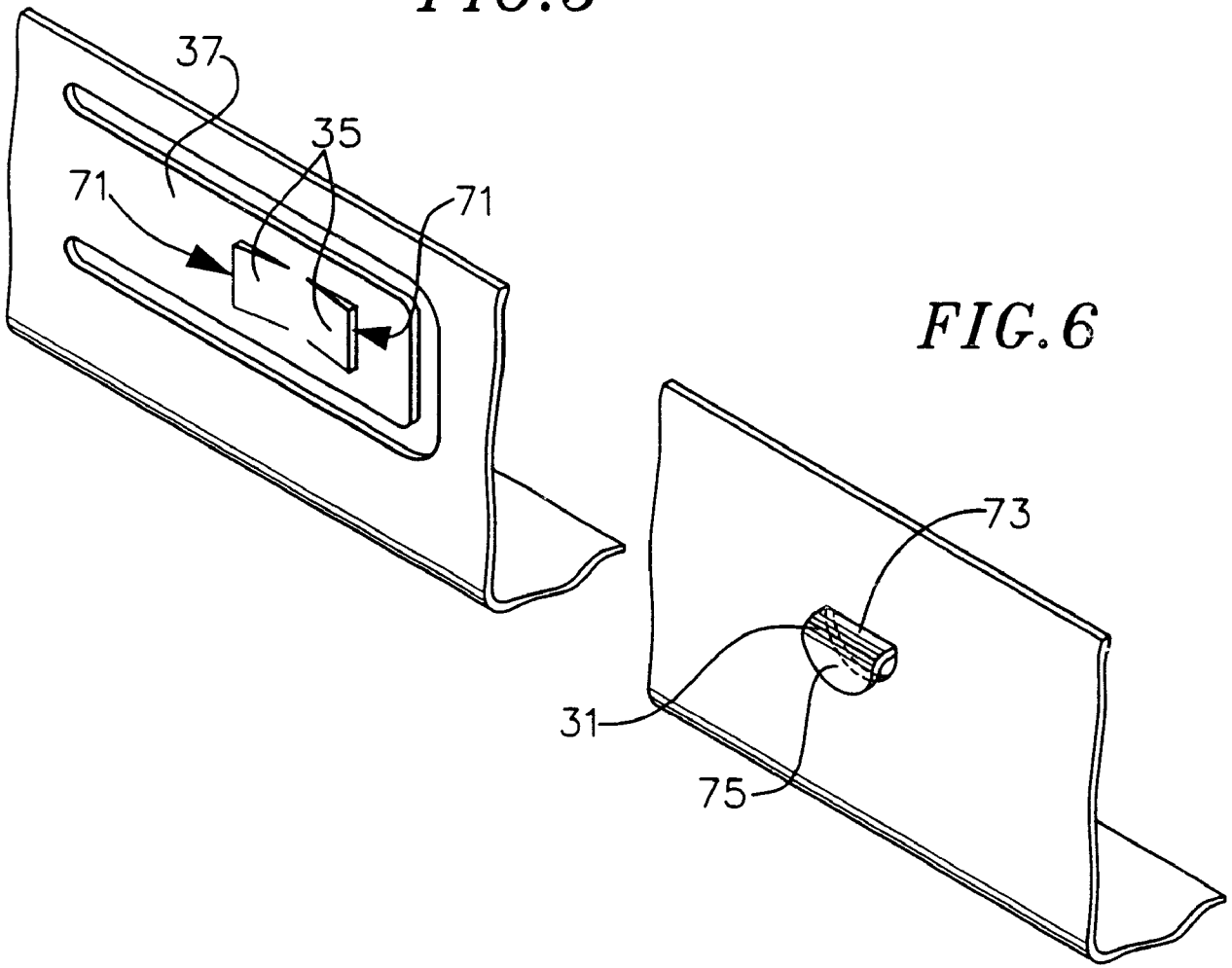
FIG. 5 is a perspective view of the flexing finger and lock tab of the present invention.
FIG. 6 is a perspective view of the support tab of the present invention.

FIG. 5 shows further details of the flexing finger 37 and lock tabs 35. As can be seen, each lock tab 35 resembles a small ramp. That is, a small tab is formed on the flexing finger 37 by pressing out an angle a small rectangular region. One side of the rectangular region is not pressed out at all and the opposing side of the rectangular region is pressed out a predetermined amount. When viewed from above or below, therefore, a lock tab 35 will appear to be of triangular section. The lock tab therefore forms an edge surface 71 protruding from the vertical mounting flange 25. In the embodiment shown two lock tabs 35 are formed in the flexing finger 37 with the face of each edge surface 71 facing away from the corresponding edge surface 71 of the other lock tab. FIG. 6 shows further details of the support tabs 31. The support tabs 31 comprise a narrow horizontal substantially rectangular base portion 73 extending horizontally from the vertical mounting flange 25. A substantially semi-circular ear shaped portion 75 extends vertically downward from the end of the base portion 73.

Figure 4:
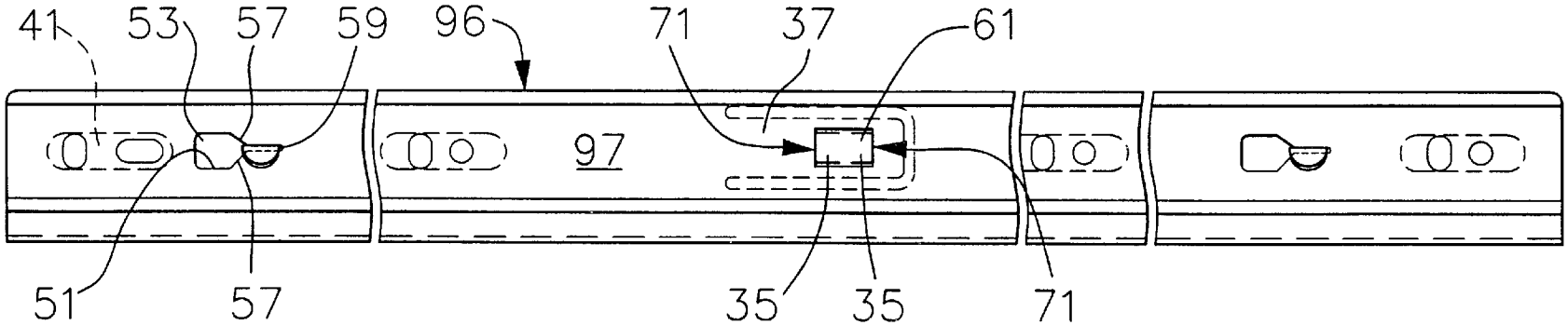
FIG. 4 is an elevational view taken from the opposite side of the elevational view of FIG. 3 of the shelf mount bracket of FIG. 2 attached to a drawer slide member of the present invention.

The web 97 of the inner slide member 96 is shown in FIG. 4 with the shelf mount bracket 23 attached thereto. In the web 97 of the inner slide member 96 are guide apertures 51. The guide apertures 51 are comprised of a large insertion opening 53 which is of sufficient dimension to allow the support tabs 31 to be placed through the aperture 51 and a slot 59. The guide aperture 51 progressively narrows on one longitudinal side with angled inward edges 57. The slot 59 extends longitudinally from this narrowing side of the aperture. Thus, the guide apertures 51 are substantially paddle shaped, with the slot representing the handle of the paddle. Once the support tabs 31 are placed in the large opening 53 of the guide aperture 51, the support tabs 31 are guided into the slots 59 by the angled edges 57 when the shelf mount bracket 23 is pushed longitudinally along the inner slide member 96.

When the support tabs 31 are located in the slots 59, the lock tabs 35 are positioned in a rectangular lock tab aperture 61 in the web of the inner slide member. The lock tab aperture 61 is of sufficient dimension such that the edge surface 71 of the lock tabs extend into the aperture 61. The shelf mount bracket 23 is restricted from moving longitudinally with respect to the inner slide member 96 by the edge surfaces 71 of the lock tabs 35 abutting the edges of the lock tab aperture 61. The shelf mount bracket 23 is restricted from lateral motion with respect to the slide member 21 by the ear shaped portions 75 of the support tabs 31, Vertical support for the shelf mount bracket 23 is largely provided by the base portion 73 of the support tabs 31 resting in the slots 59. The aperture 61 constrains the lock tabs 35*a,b*, and thus the shelf mount bracket 23, from moving in a longitudinal direction. Only a single lock tab 35 with an edge 71 facing in the one longitudinal direction is required because the slot 59 constrains the support tabs 31 from moving in the opposing longitudinal direction. The use of two lock tabs 35, however, avoids placing excess strain in the longitudinal direction on the support tabs 31, which are bearing much of the vertical load of the attached shelf. The use of two lock tabs 35 also allows for accurate positioning of the shelf mount bracket 23 as the lock tab 61 aperture is more easily formed to more exacting tolerances than the slots 59. Additionally, the same mounting bracket 23 may be used for both over shelf and under shelf applications if two lock tabs 35 are provided.

The shelf mount bracket 23 is removed from the slide member by pressing the lock tabs 35 out of the aperture 61 and away from the web of the inner slide member 96, and then sliding the shelf mount bracket 23 so that the support tabs 31 slide out of the slots 59 and into the large insertion opening 53 of the guide aperture 51. Without the flexing finger 37, pressing the lock tabs 35 out of the aperture 61 may cause the entire shelf mount bracket 23 to flex and bind the support tabs 31 in the slots 59, making removal of the support tabs 31 from the slots 59 difficult. The flexing finger 37 therefore allows for easier removal of the shelf mount bracket 23 from the slide member 96. The drawer or shelf must be removed from the shelf mount bracket 23 before the lock tabs 35 can be forced out of the aperture as the drawer or shelf is generally snugly fit against the vertical mounting flange 25.

Figure 8:
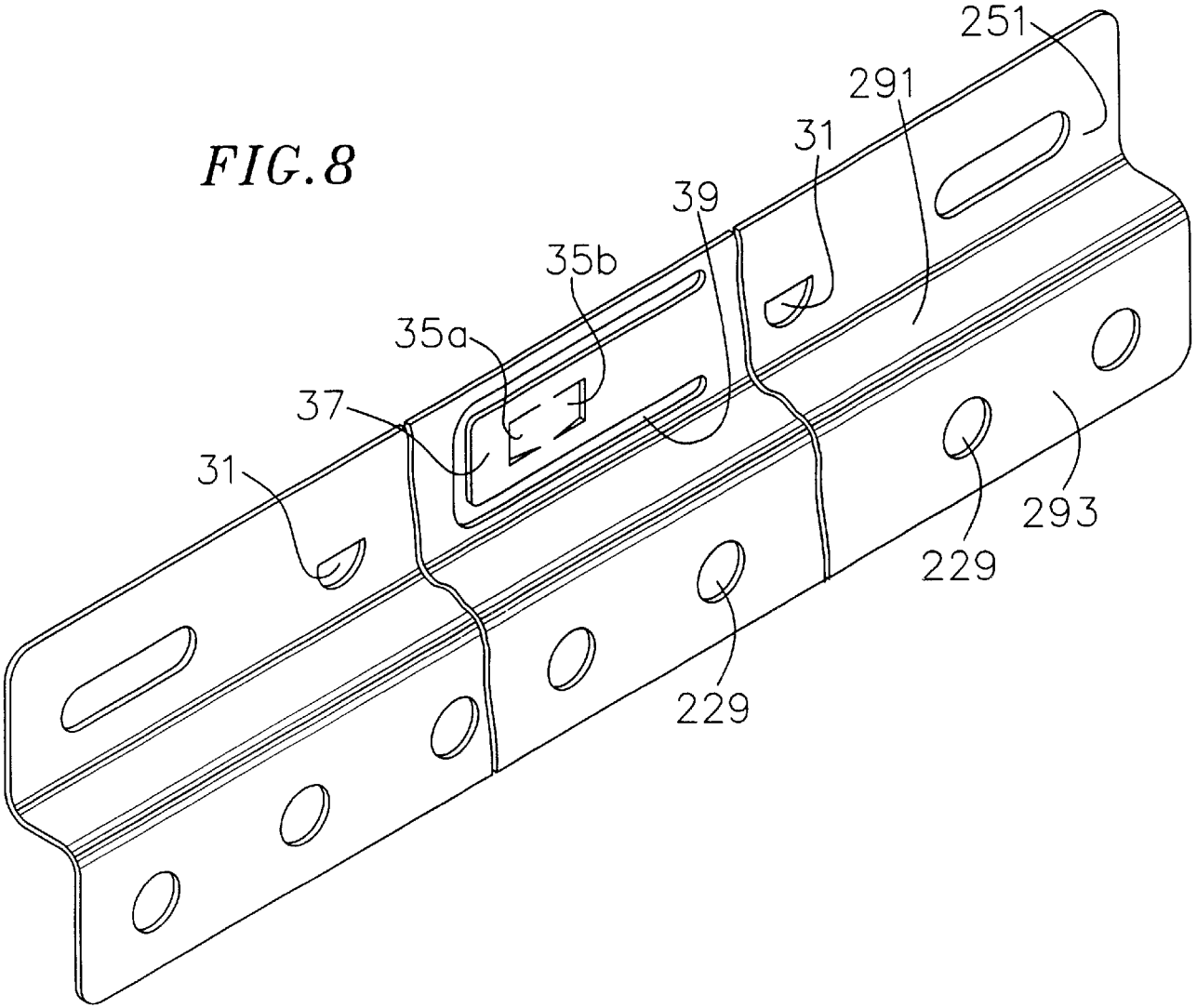
FIG. 8 is a perspective view of an offset shelf mount bracket of the present invention.

FIG. 8 illustrates an alternative drawer slide accessory incorporating the present invention. The drawer slide accessory illustrated is an offset shelf bracket. The offset shelf bracket is similar to the shelf mount bracket previously described in that it is a mounting bracket for drawers, shelves, and the like. Any longitudinally attached drawer slide accessory may be used with the present invention, however. The offset shelf bracket has a vertical mounting flange 251 similar to the mounting flange of the shelf mount bracket previously described. Extending horizontally from the vertical mounting flange 251 is an offset flange 291. The offset flange 291 is similar to the horizontal support flange previously described, but is not used for attaching a shelf to the offset shelf bracket. A second vertical flange 293 descends vertically from the end of the offset flange 293. A shelf or drawer is attached to the second vertical flange 293 by passing screws, nail, and the like through numerous holes 229 in the second vertical flange 293. The drawer or shelf attached to the second vertical flange 293 need not be removed prior to disattaching the offset shelf bracket from the slide member because the second vertical flange 293 is offset from the vertical mounting flange 281 and the shelf or drawer therefore does not restrict motion of the flexing finger 37.

Although this invention has been described in certain specific embodiments, many additional modifications and variations will be apparent to those skilled in the art. It is therefore to be understood that this invention may be practiced otherwise and as specifically described. For example, any drawer slide accessory which is desired to be attached to the web of a slide member could be attached using the present invention, not just shelf mounting brackets. Additionally, the support tabs and the lock tabs can be formed in a variety of shapes other than those disclosed so long as the essential function of constraining movement of the accessory with respect to the drawer slide is achieved. Thus, the present embodiments of the invention should be considered in all respects as illustrative and not restrictive, the scope of the invention to be indicated by the appended claims rather than the foregoing description.

What is claimed is:

1. A drawer slide member comprising:

a vertical web;

a guide aperture in the vertical web, the guide aperture comprising an insertion opening with angled sides leading to a slot extending from the insertion opening;

wherein the insertion opening is substantially square and the angled sides form a triangular portion extending from the square with the angled sides forming an apex of the triangular portion distal from the square insertion opening, and the slot extends from the apex of the triangular portion.

2. The drawer slide member of claim 1 wherein the slide member extends longitudinally when part of a drawer slide and the slot extend longitudinally along the slide member.

3. The drawer slide member of claim 2 wherein the web has two guide apertures astraddle a lock tab aperture.

4. A drawer slide attachment for a drawer slide with slidably connected drawer slide members which extend longitudinally with respect to each other, said drawer slide attachment comprising:

a vertical mounting flange having a longitudinal length;

a flexing finger inset in the vertical mounting flange;

two projections extending in a horizontal direction from the flexing finger; and two bayonets projecting in the horizontal direction from the vertical mounting flange longitudinally astraddle the flexing finger.

* * * * *

UNITED STATES PATENT AND TRADEMARK OFFICE

CERTIFICATE OF CORRECTION

PATENT NO. : 6,416,145 B1
DATED : July 9, 2002
INVENTOR(S) : Atma Kainth Singh

It is certified that error appears in the above-identified patent and that said Letters Patent is hereby corrected as shown below:

Title page,
Item [63], delete "Pat. No. 5,980,077" and insert -- Pat. No. 5,980,007 --.
Item [57], ABSTRACT,
Line 2, after "bracket" delete -- are provided --.

Column 1,
Line 20, after "permit" insert -- easy --.

Column 4,
Line 32, "restricted" should be -- constrained --.
Line 33, after "31" delete "," and insert -- . --.

Signed and Sealed this

Twenty-second Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,416,145 B1
DATED : July 9, 2002
INVENTOR(S) : Atma Kainth Singh

It is certified that error appears in the above-identified patent and that said Letters Patent is hereby corrected as shown below:

Title page,
Item [73], Assignee, delete the comma "," after "International" to read
-- Accuride International Inc. --

Signed and Sealed this

Thirty-first Day of August, 2004

JON W. DUDAS
*Director of the United States Patent and Trademark Office*